US008668275B2

(12) United States Patent
Hall et al.

(10) Patent No.: US 8,668,275 B2
(45) Date of Patent: Mar. 11, 2014

(54) PICK ASSEMBLY WITH A CONTIGUOUS SPINAL REGION

(76) Inventors: David R. Hall, Provo, UT (US); Ronald B. Crockett, Payson, UT (US)

( * ) Notice: Subject to any disclaimer, the term of this patent is extended or adjusted under 35 U.S.C. 154(b) by 76 days.

(21) Appl. No.: 13/177,296

(22) Filed: Jul. 6, 2011

(65) Prior Publication Data

US 2013/0009446 A1 Jan. 10, 2013

(51) Int. Cl.
*E21C 35/18* (2006.01)

(52) U.S. Cl.
USPC ..... 299/79.1

(58) Field of Classification Search
USPC ..... 299/79.1, 85.2, 100–111, 112 R, 112 T, 299/113
See application file for complete search history.

(56) References Cited

U.S. PATENT DOCUMENTS

| | | | | |
|---|---|---|---|---|
| 2,004,315 | A | | 6/1935 | Fean |
| 2,124,438 | A | | 7/1938 | Struk |
| 3,254,392 | A | | 6/1966 | Novkov |
| 3,746,396 | A | | 7/1973 | Radd |
| 3,807,804 | A | | 4/1974 | Kniff |
| 3,830,321 | A | | 8/1974 | McKenry |
| 3,865,437 | A | | 2/1975 | Crosby |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,098,362 | A | | 7/1978 | Bonnice |
| 4,109,737 | A | | 8/1978 | Bovenkerk |
| 4,156,329 | A | | 5/1979 | Daniels |
| 4,199,035 | A | | 4/1980 | Thompson |
| 4,201,421 | A | | 5/1980 | Den Besten |
| 4,277,106 | A | | 7/1981 | Sahley |
| 4,439,250 | A | | 3/1984 | Acharya |
| 4,465,221 | A | | 8/1984 | Schmidt |
| 4,484,644 | A | | 11/1984 | Cook |
| 4,489,986 | A | | 12/1984 | Dziak |
| 4,655,508 | A | * | 4/1987 | Tomlinson ..... 299/112 R |
| 4,678,237 | A | | 7/1987 | Collin |
| 4,682,987 | A | | 7/1987 | Brady |
| 4,688,856 | A | | 8/1987 | Elfgen |
| 4,725,098 | A | | 2/1988 | Beach |
| 4,729,603 | A | | 3/1988 | Elfgen |
| 4,765,686 | A | | 8/1988 | Adams |
| 4,765,687 | A | | 8/1988 | Parrott |
| 4,776,862 | A | | 10/1988 | Wiand |
| 4,880,154 | A | | 11/1989 | Tank |
| 4,932,723 | A | | 6/1990 | Mills |
| 4,940,288 | A | | 7/1990 | Stiffler |
| 4,944,559 | A | | 7/1990 | Sionnet |
| 4,951,762 | A | | 8/1990 | Lundell |
| 5,011,515 | A | | 4/1991 | Frushour |
| 5,112,165 | A | | 5/1992 | Hedlund |

(Continued)

FOREIGN PATENT DOCUMENTS

| | | |
|---|---|---|
| DE | 3500261 | 7/1986 |
| DE | 3818213 | 11/1989 |

(Continued)

*Primary Examiner* — Sunil Singh
(74) *Attorney, Agent, or Firm* — Philip W. Townsend, III

(57) ABSTRACT

In one aspect of the present invention, a pick assembly is configured to reduce aggregate drag that is formed during a degradation process. The pick assembly is configured to redirect the flow of the aggregate to conserve energy and maintain efficiency during the degradation process.

7 Claims, 9 Drawing Sheets

(56) References Cited

U.S. PATENT DOCUMENTS

| | | | | |
|---|---|---|---|---|
| 5,141,289 | A | 8/1992 | Stiffler | |
| 5,154,245 | A | 10/1992 | Waldenstrom | |
| 5,186,892 | A | 2/1993 | Pope | |
| 5,251,964 | A | 10/1993 | Ojanen | |
| 5,261,499 | A | 11/1993 | Grubb | |
| 5,332,348 | A | 7/1994 | Lemelson | |
| 5,417,475 | A | 5/1995 | Graham | |
| 5,447,208 | A | 9/1995 | Lund | |
| 5,535,839 | A | 7/1996 | Brady | |
| 5,542,993 | A | 8/1996 | Rabinkin | |
| 5,653,300 | A | 8/1997 | Lund | |
| 5,738,698 | A | 4/1998 | Kapoor | |
| 5,823,632 | A | 10/1998 | Burkett | |
| 5,837,071 | A | 11/1998 | Andersson | |
| 5,845,547 | A | 12/1998 | Sollami | |
| 5,875,862 | A | 3/1999 | Jurewicz | |
| 5,934,542 | A | 8/1999 | Nakamura | |
| 5,935,718 | A | 8/1999 | Demo | |
| 5,944,129 | A | 8/1999 | Jensen | |
| 5,967,250 | A | 10/1999 | Lund | |
| 5,992,405 | A | 11/1999 | Sollami | |
| 6,006,846 | A | 12/1999 | Tibbitts | |
| 6,019,434 | A | 2/2000 | Emmerich | |
| 6,044,920 | A | 4/2000 | Massa | |
| 6,051,079 | A | 4/2000 | Andersson | |
| 6,056,911 | A | 5/2000 | Griffin | |
| 6,065,552 | A | 5/2000 | Scott | |
| 6,113,195 | A | 9/2000 | Mercier | |
| 6,170,917 | B1 | 1/2001 | Heinrich | |
| 6,193,770 | B1 | 2/2001 | Sung | |
| 6,196,636 | B1 | 3/2001 | Mills | |
| 6,196,910 | B1 | 3/2001 | Johnson | |
| 6,199,956 | B1 | 3/2001 | Kammerer | |
| 6,216,805 | B1 | 4/2001 | Lays | |
| 6,270,165 | B1 | 8/2001 | Peay | |
| 6,341,823 | B1 | 1/2002 | Sollami | |
| 6,354,771 | B1 | 3/2002 | Bauschulte | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,478,383 | B1 | 11/2002 | Ojanen | |
| 6,499,547 | B2 | 12/2002 | Scott | |
| 6,517,902 | B2 | 2/2003 | Drake | |
| 6,585,326 | B2 | 7/2003 | Sollami | |
| 6,685,273 | B1 | 2/2004 | Sollami | |
| 6,692,083 | B2 | 2/2004 | Latham | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,851,758 | B2 | 2/2005 | Beach | |
| 6,854,810 | B2 | 2/2005 | Montgomery, Jr. | |
| 6,861,137 | B2 | 3/2005 | Griffin et al. | |
| 6,889,890 | B2 | 5/2005 | Yamazaki | |
| 6,966,611 | B1 | 11/2005 | Sollami | |
| 6,994,404 | B1 | 2/2006 | Sollami | |
| 7,204,560 | B2 | 4/2007 | Mercier | |
| 7,396,086 | B1 * | 7/2008 | Hall et al. | 299/113 |
| 2002/0175555 | A1 | 11/2002 | Mercier | |
| 2003/0141350 | A1 | 7/2003 | Noro | |
| 2003/0209366 | A1 | 11/2003 | McAlvain | |
| 2003/0234280 | A1 | 12/2003 | Cadden | |
| 2004/0026983 | A1 | 2/2004 | McAlvain | |
| 2004/0065484 | A1 | 4/2004 | McAlvain | |
| 2005/0023043 | A1 * | 2/2005 | Tufts | 175/374 |
| 2005/0159840 | A1 | 7/2005 | Lin | |
| 2005/0173966 | A1 | 8/2005 | Mouthaan | |
| 2006/0237236 | A1 | 10/2006 | Sreshta | |
| 2010/0259092 | A1 * | 10/2010 | Kelly et al. | 299/110 |

FOREIGN PATENT DOCUMENTS

| | | |
|---|---|---|
| DE | 4039217 | 6/1992 |
| DE | 19821147 | 11/1999 |
| DE | 10163717 | 5/2003 |
| EP | 0295151 | 12/1988 |
| EP | 0412287 | 2/1991 |
| GB | 2004315 | 3/1979 |
| GB | 2037223 | 7/1980 |
| JP | 5280273 | 10/1993 |

* cited by examiner

PICK ASSEMBLY WITH A CONTIGUOUS SPINAL REGION

BACKGROUND OF THE INVENTION

The present invention relates generally to formation degradation machines and specifically to road milling and mining machines. A pick assembly is generally attached to drums, drill bits, wheels, or chains, which are configured to drive the pick assemblies into the formation with an impacting force that degrades the formation's surface.

U.S. Patent Application No. 2005/0056437 to Gaudielle et al., which is herein incorporated for all that it contains, discloses a pick that comprises a handle and a pick head coupled to the handle at an acute angle thereto. The pick head has a top, and first and second side edges, which extend away from the top and meet at a bottom point. The pick head includes at least one tab extending from the pick head top toward the handle. The tab has a length sufficient to serve as a foot support and as a striking surface.

U.S. Pat. No. 7,401,863 to Hall et al., which is herein incorporated for all that it contains, discloses a pick that comprises a shank attached to a base of a steel body, a cemented metal carbide core press fit into the steel body opposite the shank, and an impact tip bonded to a first end of the core opposite the shank. The impact tip comprises a superhard material opposite the core, and the core comprises a second end and a largest diameter. A distance through the body from the shank to the second end of the core is less than the largest diameter of the core.

U.S. Pat. No. 7,338,135 to Hall et al., which is herein incorporated for all that it contains, discloses a degradation assembly that has an attack tool with a body and a shank, the body having a wear-resistant tip. The shank is disposed within a bore of a holder secured to a driving mechanism. The bore of the holder comprises an inner surface comprising a hardness greater than 58 HRC.

BRIEF SUMMARY OF THE INVENTION

In one aspect of the present invention, a pick assembly comprises a body with a central axis that intersects a working end and a base end. The base end comprises a shank that is configured to be rotationally fixed within a block of a driving mechanism. The working end comprises a tip that is harder than the body and configured to degrade a formation. The body further comprises a streamlined side that is configured to reduce resistance resulting from a flow of aggregate as the tip degrades the formation. The streamlined side may be configured to reduce the pick assembly's drag through the degraded aggregate. The pick assembly also comprises a support side, or spinal region, that is configured to support the tip.

The support side, or spinal region, comprises a spine with a braze end that forms a bond interface with the tip and a bolstering end that is opposite the braze end. An external surface of the spine progressively advances towards the central axis at the braze end. The streamlined side comprises a bulge opposite the bolstering end of the spine. The bulge may be at least partially formed in a carbide portion of the body. At least one recess is formed between the bulge and the spine and is configured to direct the flow of aggregate around the pick assembly's body.

The recess may be configured to reduce surface contact that may occur between the assembly's body and the formation being degraded. The recess may comprise a steeper incline proximate the tip and a gradual incline proximate the bulge.

The reduced contact between the pick assembly and loose aggregate may decrease friction, which will reduce the overall energy consumption. The reduced surface contact may further enable the aggregate to more easily flow past the pick assembly.

The body of the pick may further be configured to shield the support side, or spinal region, of the pick from the formation being degraded. The external surface of the spine may comprise a curved geometry. The curved geometry may provide necessary support along the body to adequately support the tip while shielding the support side, or spinal region, from the formation.

The assembly's body may comprise a carbide section and metal section that are bonded together. The carbide section may be bonded to the tip, which may comprise a carbide substrate and a superhard working surface. The superhard material may be sintered polycrystalline diamond. In some embodiments, the carbide substrate is brazed at a planar interface to the carbide section. In some embodiments, the pick assembly's base end may comprise a substantially circular geometry.

In some embodiments, the recess and spine may be formed in the carbide section of the body. The body may also comprise a steel portion that forms a proximal spine, at least one proximal recess, and a proximal bulge. The recesses may redirect the aggregate pathway to flow around the assembly's body with minimal resistance.

The body may comprise at least two recesses. The recesses may be formed between the spine and a first and second side of the bulge. The recesses may be in close proximity to another near the bulge and diverge away from one another as they approach the support side, or spinal region.

DETAILED DESCRIPTION OF THE INVENTION AND THE PREFERRED EMBODIMENT

Figure 1:
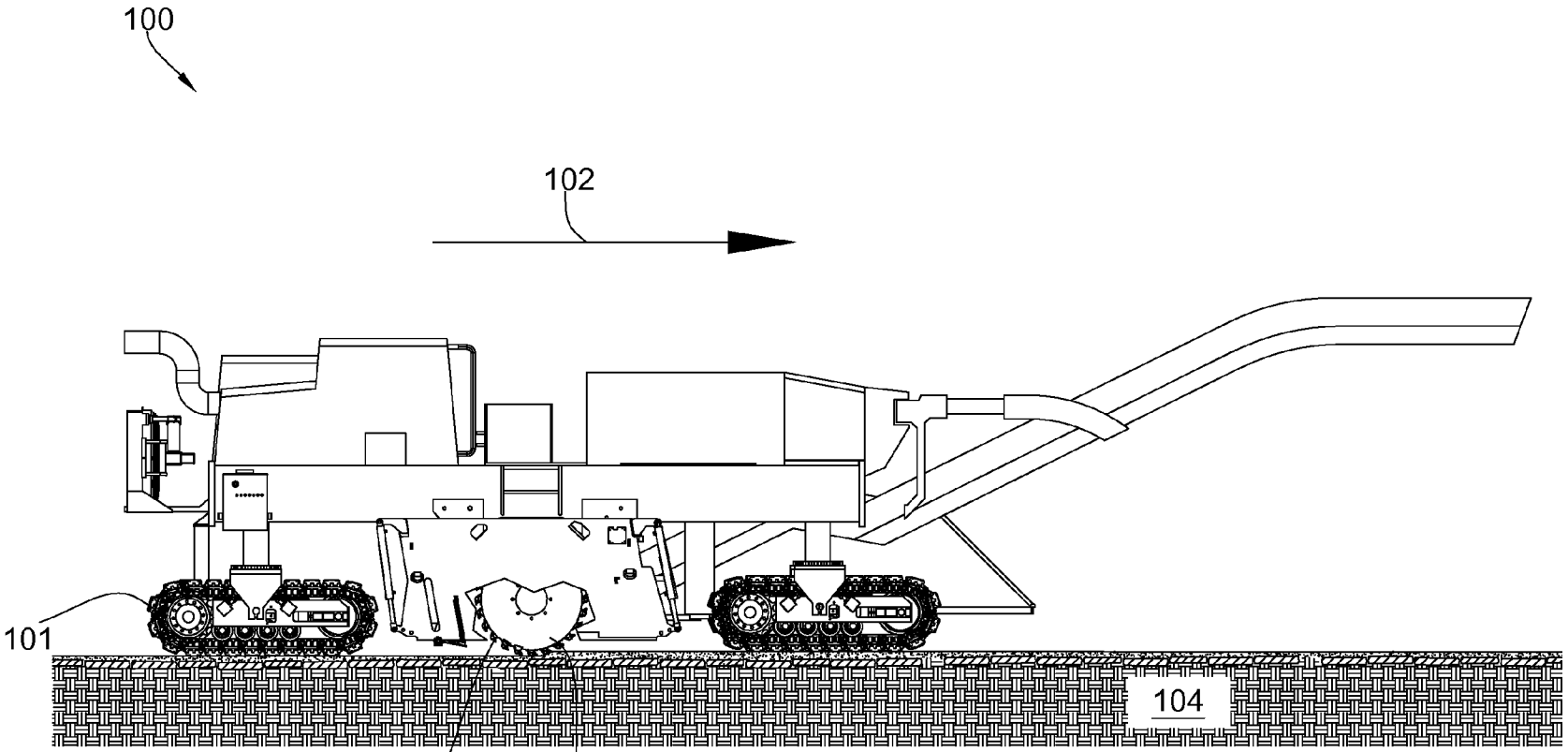
FIG. 1 discloses an orthogonal view of an embodiment of a degradation system.

Referring now to the figures, FIG. 1 discloses an embodiment of a degradation system. The degradation system may comprise a milling machine 100. At least one set of continuous tracks 101 may be disposed on an underside of the milling machine 100 and the continuous tracks 101 may be configured to propel the machine 100 into motion in the direction of the arrow 102. Additionally, a driving mechanism may be disposed on the underside of the machine 100. The driving mechanism may comprise a rotary degradation drum 103 that is configured to degrade a formation 104. The degradation drum 103 may comprise at least one pick assembly 105. In other embodiments, the pick assembly 105 may be attached to a mining machine. Also, in some embodiments, the pick assembly 105 may be secured to a chain or drill driving mechanism.

Figure 2:
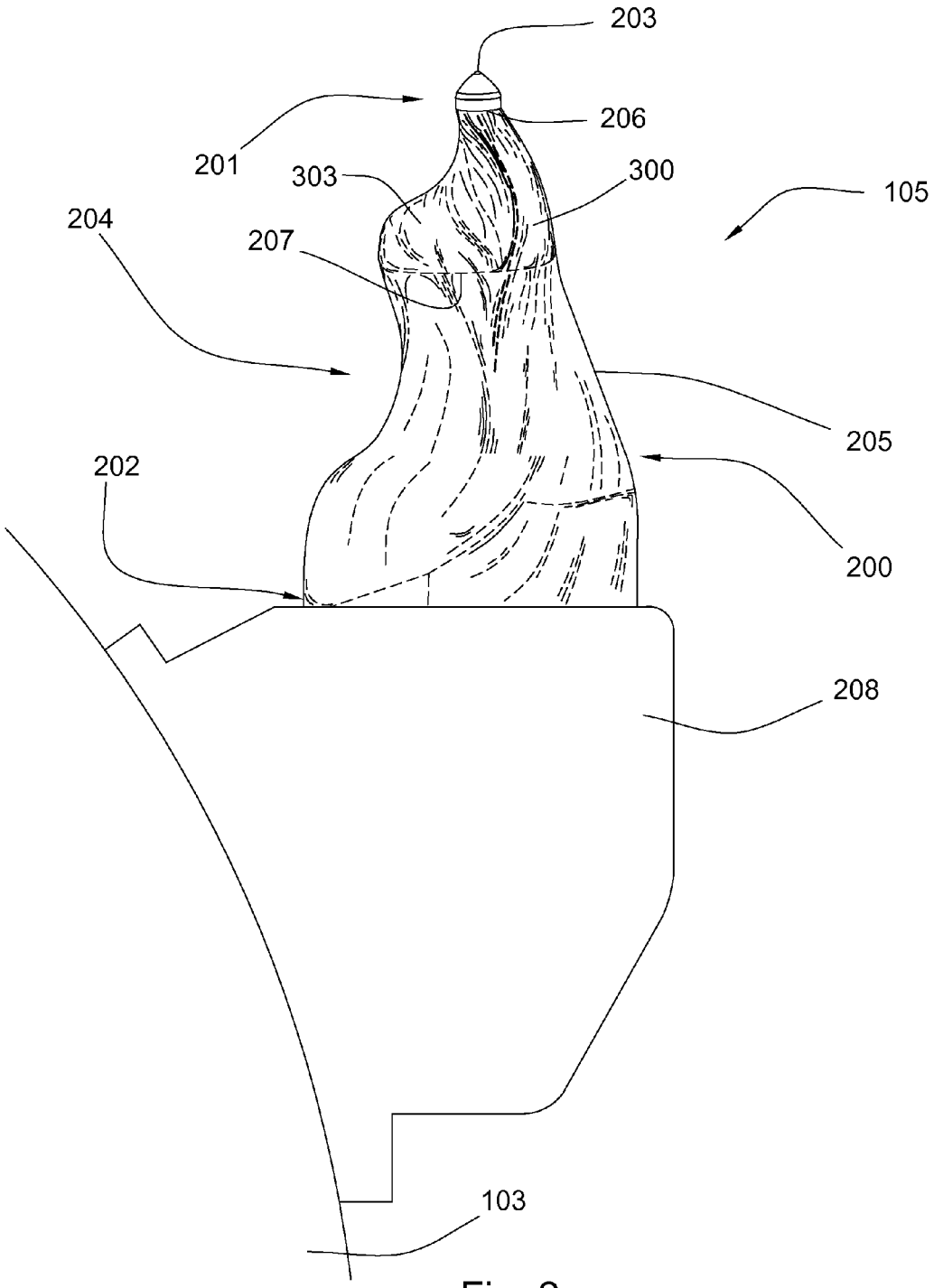
FIG. 2 discloses a perspective view of an embodiment of a pick assembly.

FIG. 2 discloses a perspective view of the pick assembly 105 with a body 200 and a central axis. The central axis may intersect both a working end 201 and a base end 202. The working end 201 may comprise a tip 203 that comprises a harder material than the body 200 and is configured to degrade the formation. Preferably, the tip 203 may comprise a superhard material, which may be selected from polycrystalline diamond, sintered diamond, natural diamond, cubic boron nitride, silicon carbide, or combinations thereof. The tip 203 may be configured to comprise the harder material because the tip 203 may be the first component of the pick assembly 105 to impact the formation during degradation. Consequently, the tip 203 may bear a majority of the degradation forces.

The base end 202 may comprise a shank (not shown) that is configured to be rotationally fixed within a block 208 of the rotary degradation drum 103 or other driving mechanism. The tip 203 may wear at a slower rate in comparison to the rest of the pick assembly 105 due to the tip material's wear resistant properties. In some embodiments, the tip may rotate.

A support side 205, or spinal region, may support the tip 203. The body 200 may shield the support side 205, or spinal region, from the formation.

The body 200 may also comprise a streamlined side 204 configured to reduce a resistance force that may result from a flow of aggregate as the tip 203 degrades the formation. The streamlined side 204 may be configured to improve the flow of degraded aggregate around the pick assembly 105 by redirecting the flow of loose aggregate through recesses formed between a bulge 303 of the streamlined side 204 and a spine 300 of the support side 205, or spinal region.

The pick assembly 105 may comprise a carbide section and a metal section, such as a steel section. The carbide section may be bonded to the metal section at a braze joint. The carbide section may also be bonded to the pick assembly's tip 203.

The base end 202 may comprise a substantially circular geometry. The working end 201 may be significantly smaller than the base end 202, thereby, focusing the impact force just ahead of the tip 203.

Figure 3:
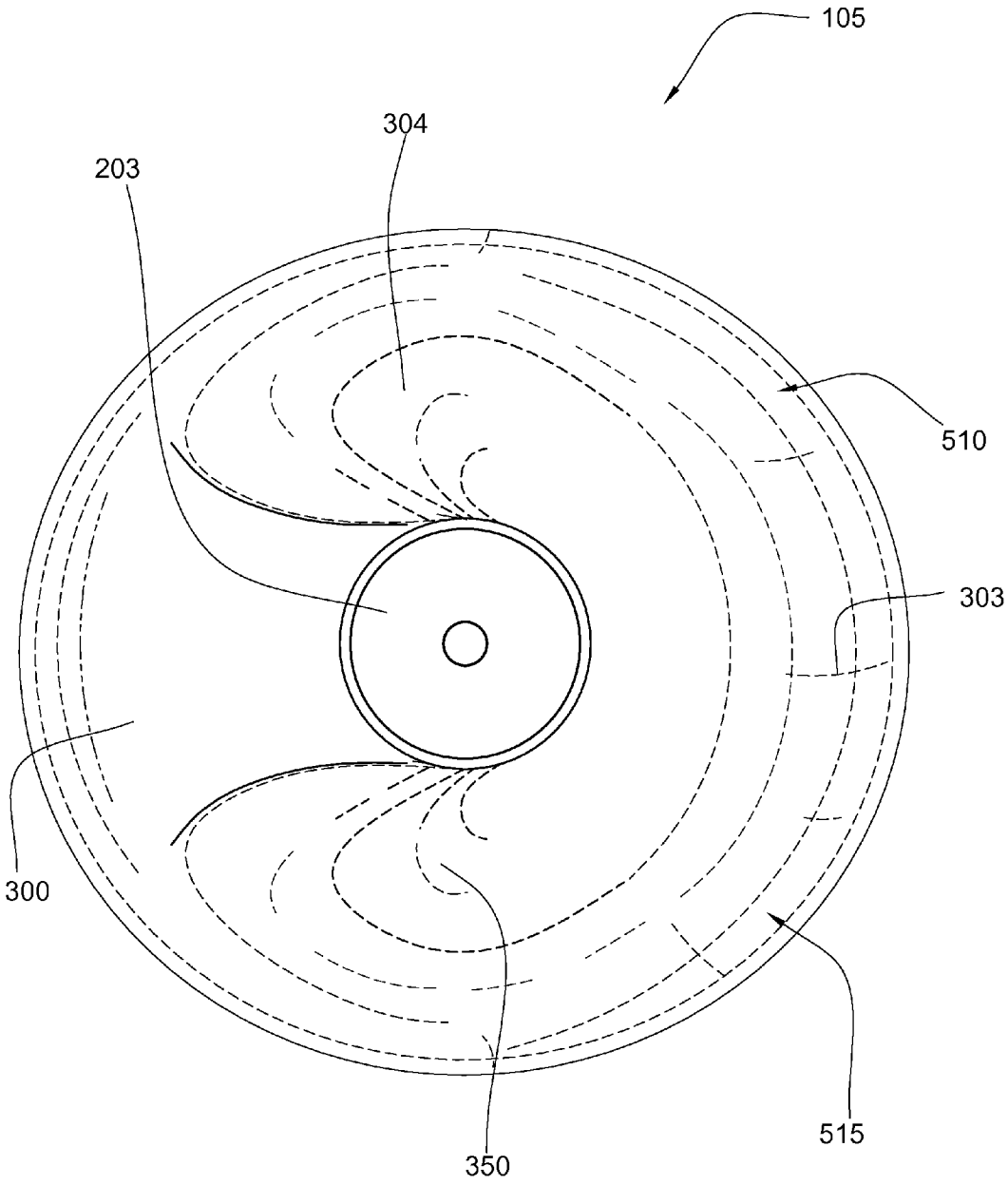
FIG. 3 discloses a perspective view of an embodiment of a pick assembly.

FIG. 3 discloses a top view of the pick assembly 105. Preferably, the central axis of the pick assembly 105 intersects the tip 203. The embodiment of FIG. 3 discloses recesses 304, 350. The first recess 304 may be formed between the spine 300 and a first side 510 of the bulge 303. The second recess 350 may be formed on a second side 515 of the bulge 303. Recesses 304, 350 may be proximate one another near the bulge 303 and may diverge as the recesses 304, 350 approach the spine 300 of the support side 205, or spinal region.

Figure 4:
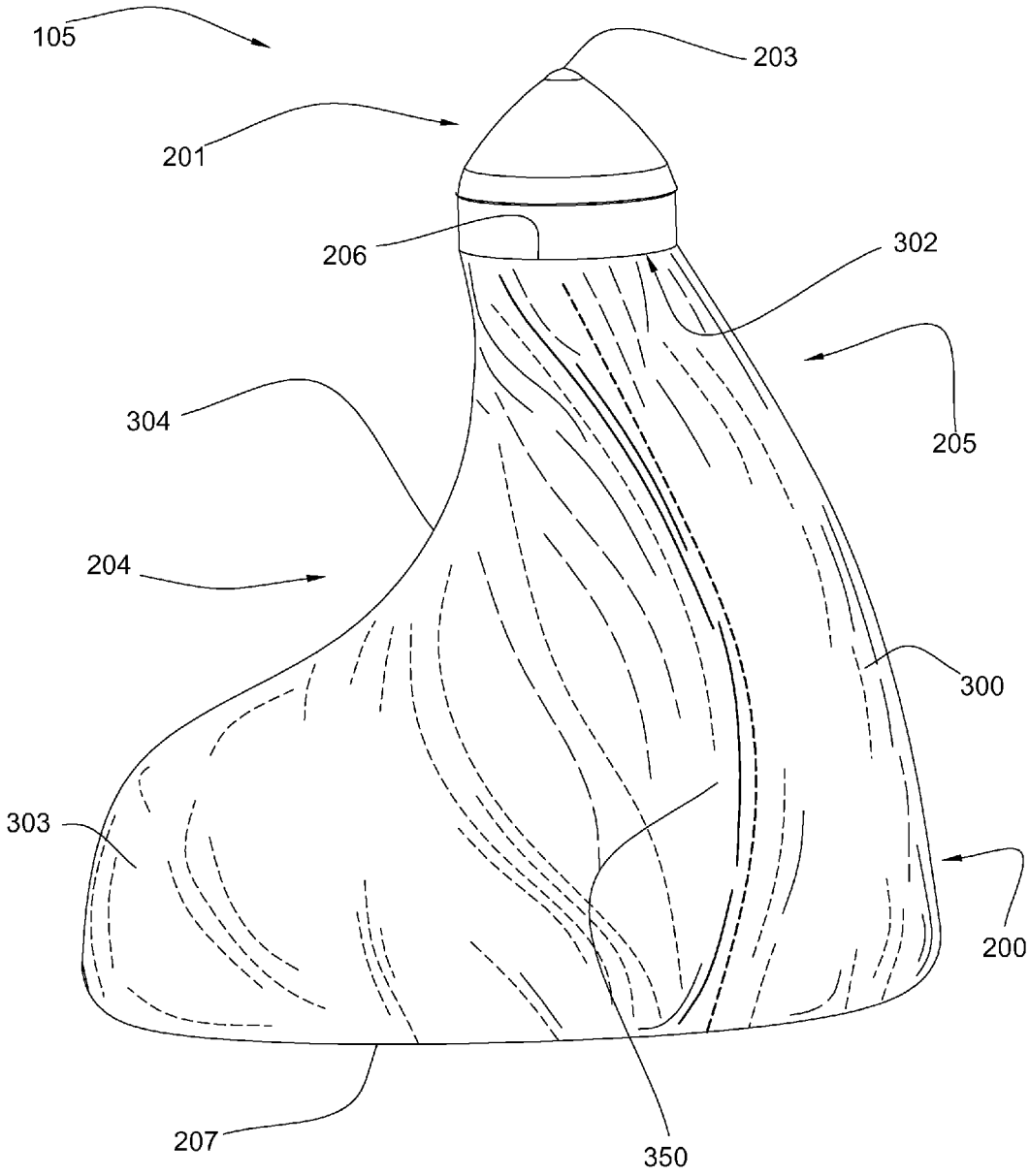
FIG. 4 discloses a side view of an embodiment of a pick assembly.

FIG. 4 discloses a portion of the pick assembly 105. The support side 205, or spinal region, may comprise the spine 300 with the braze end 206. A bond interface 302 located along the braze end 206 may connect the spine 300 to the tip 203. The spine 300 may also comprise the bolstering end 207 that may be disposed opposite the braze end 206.

An external surface of the spine 300 may progressively advance towards the central axis at the braze end 206. The progressive advancement may result in the working end 201 becoming substantially smaller than the base end.

The external surface of the spine 300 may comprise a curved geometry. The curved geometry may aid in shielding the support side 205, or spinal region, from the formation and in evenly distributing forces that are applied to the spine 300 throughout the degradation process.

The streamlined side 204 may comprise the bulge 303 proximate the bolstering end 207 of the spine 300. The bulge 303 may be at least partially formed in the carbide portion of the body 200. The bulge 303 may comprise a material with a high hardness rating to prevent erosion from occurring at the bulge 303. In some embodiments, the bulge 303 may be partially formed in the metal portion of the pick assembly 105. The bulge 303 may force loose aggregate into the recesses 304, 350 that are formed between the bulge 303 and the spine 300. These recesses 304, 350 may further direct the loose aggregate away from the pick assembly's body 200 along a low friction path that is designed to reduce drag.

In some embodiments, the recesses are formed in a carbide section. The recesses' geometry may reduce erosion on the pick body 200. The recesses 304, 350 may comprise a gradual curve near the bulge 303 and the curve may become steeper near the support side 205, or spinal region. The bulge 303 may, in effect, plow through loose aggregate forcing the aggregate into the recesses 304, 350 along the gradual curve. The entrance into the recesses 304, 350 may be narrower than the base of the pick body 200. Thus, the loose aggregate may be effectively directed into either recess 304, 350. Preferably, the recesses 304, 350 efficiently direct the aggregate away from the pick while keeping the aggregate away from the support side 205, or spinal region, which has the function of supporting the tip 203.

Figure 5:
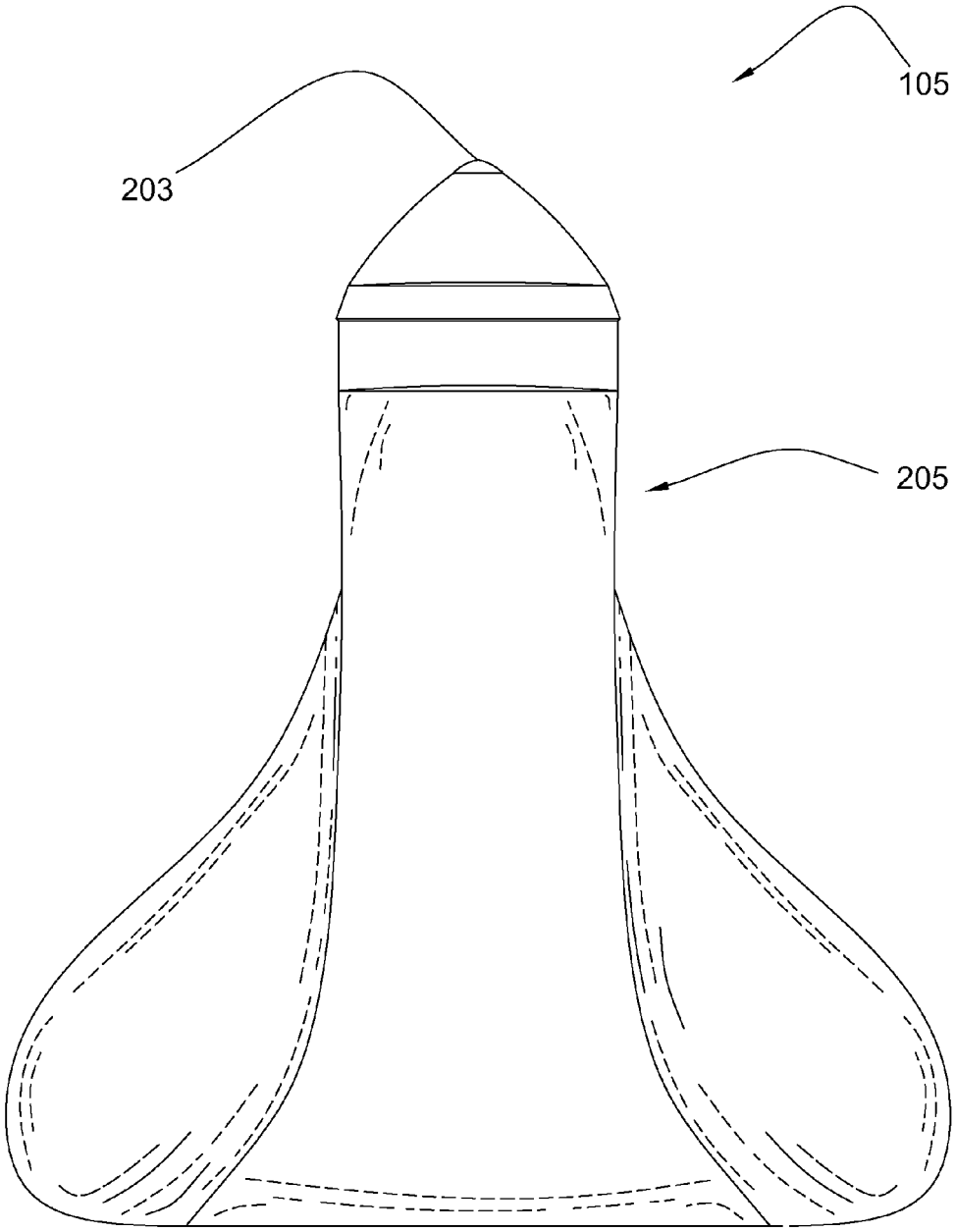
FIG. 5 discloses a top view of an embodiment of a pick assembly.
Figure 6:
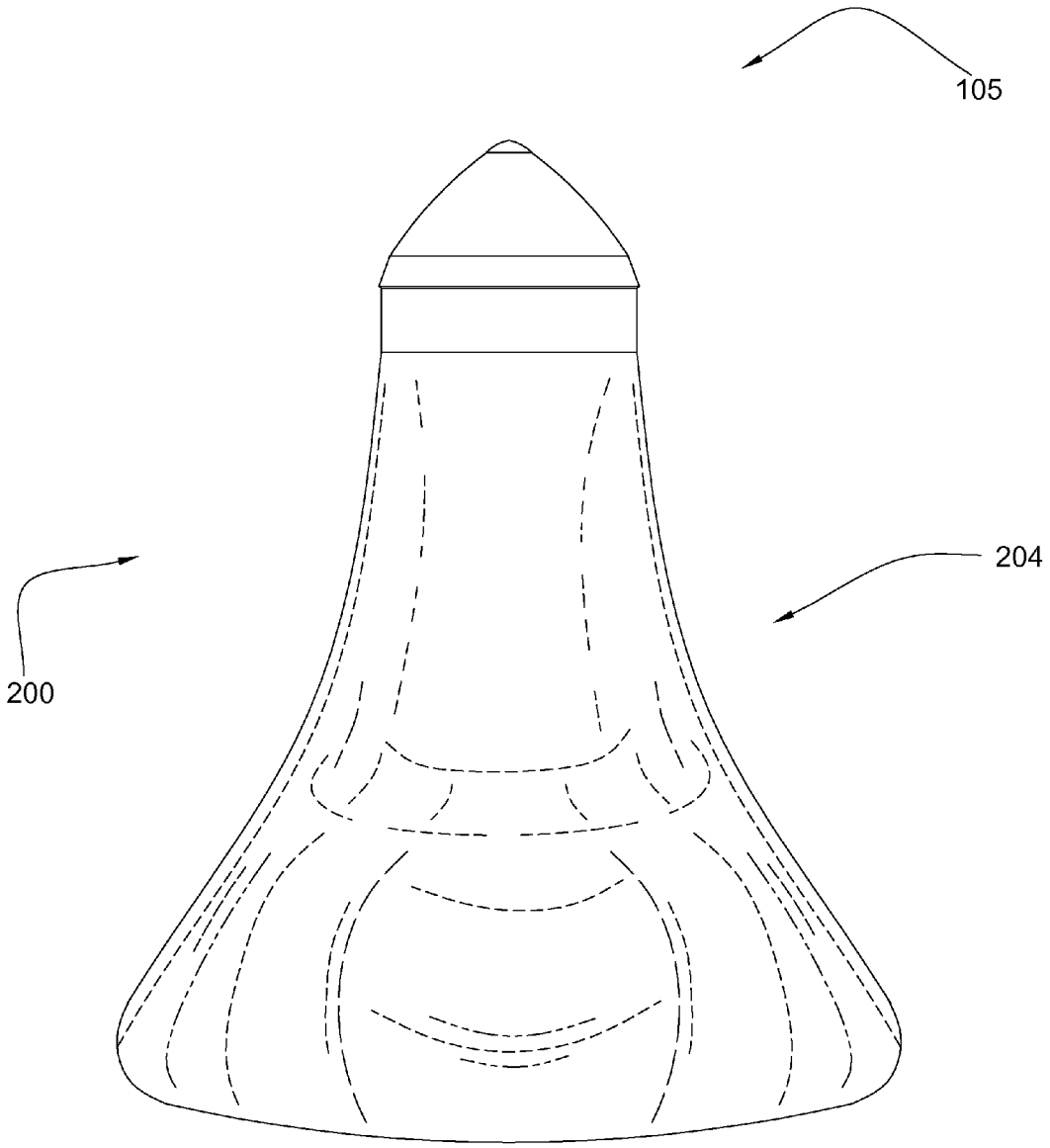
FIG. 6 discloses a side view of an embodiment of a pick assembly.

FIG. 5 discloses an orthogonal view of the support side 205, or spinal region, which may provide support to the tip 203 of the pick assembly 105. FIG. 6 discloses an orthogonal view of the pick assembly 105 from the streamlined side 204.

The geometry of the present invention may conserve the material of the pick assembly's body 200. In the current embodiment, the pick assembly 105 may be formed through a mold or another alternative manufacturing process.

Figure 7:
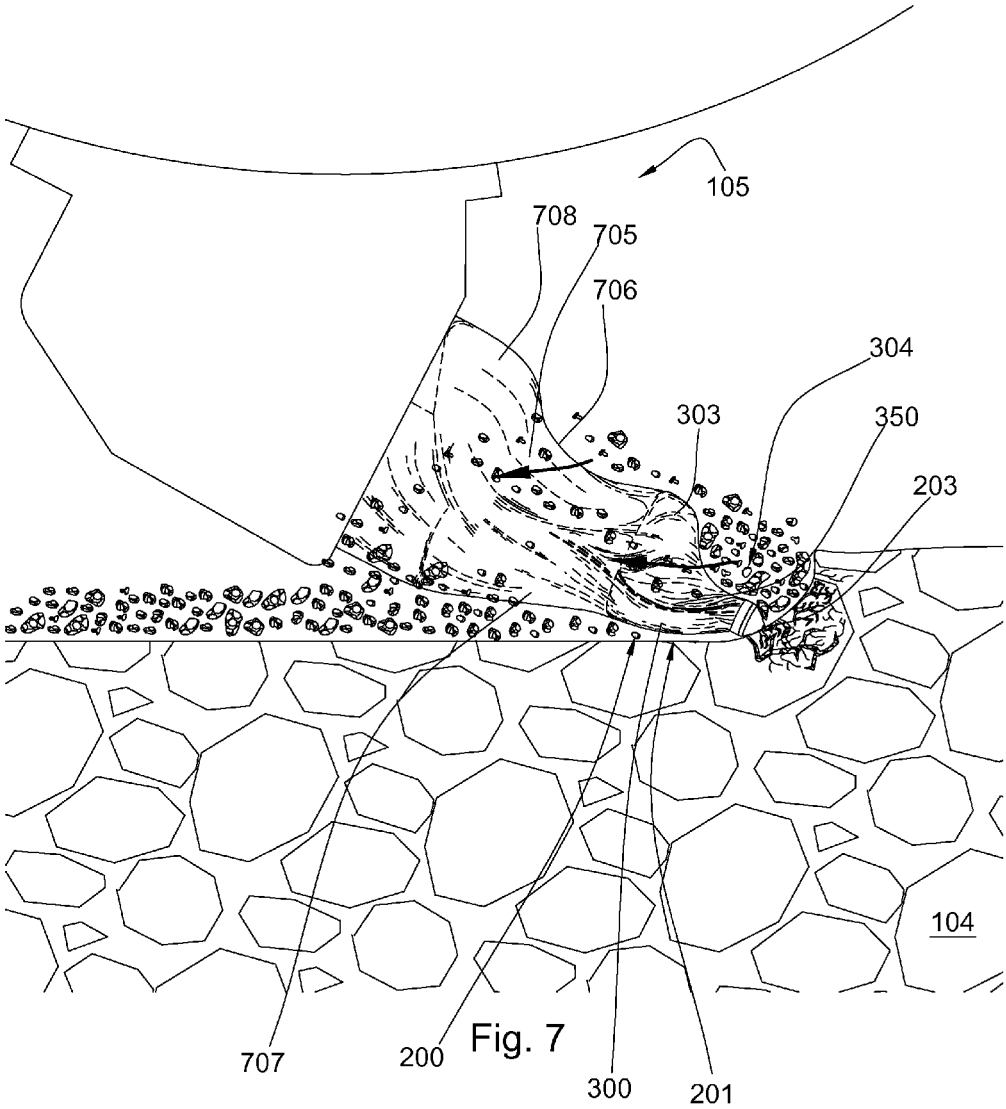
FIG. 7 discloses a perspective view of an embodiment of a pick assembly.

FIG. 7 discloses a perspective view of the pick assembly 105 degrading the formation 104. The recesses 304, 350 may be configured to reduce surface contact occurring between the body 200 and the formation 104 being degraded. The recesses 304, 350 may comprise a steeper incline proximate the tip 203 and a more gradual incline proximate the bulge 303. The steeper incline may be configured to further decrease surface contact occurring between the pick assembly's body 200 and the formation 104, particularly the surface contact occurring proximate the working end 201 of the pick assembly 105. The reduced surface contact may decrease friction occurring between the formation 104 and the pick assembly 105 to further increase the pick assembly's efficiency. The decreased friction may result in reduced energy absorption during aggregate displacement. The reduced energy absorption may result in an overall reduction of energy consumption during a degradation process.

The recesses 304, 350 may further be configured to prevent degraded aggregate buildup from occurring during the degradation process and specifically to prevent buildup from occurring proximate the tip 203. The recesses 304, 350 may provide an area or pathway for the degraded aggregate to flow through to clear up the formation 104 currently being degraded. The buildup prevention may improve a pick's ability to degrade through the formation 104 by reducing the aggregate that the pick assembly 105 must go through to reach the formation 104.

The recesses 304, 350 may be configured to funnel aggregate around the body 200 of the pick assembly 105, directing the aggregate away from the pick's body 200. By directing the aggregate away from the pick's body 200, an impact between the aggregate and body 200 may decrease in magnitude.

At least one proximal recess 705, 706 may be disposed away from the distal recesses 304, 350 along the length of the pick assembly and may be formed in the metal portion of the pick assembly 105. The proximal recesses 705, 706 may divert the degraded aggregate to either side of the pick assembly 105 and away from the body 200 of the pick assembly 105. The proximal recesses 705, 706 may further direct the loose aggregate along a low friction path designed to reduce the drag.

Additionally, the metal portion may form a proximal spine 707 near the proximal recesses 705, 706 and spaced away from the distal spine 300. The proximal spine 707 may provide additional support to the pick assembly 105. The metal portion may also form a proximal bulge 708 proximate the proximal recesses 705, 706 and opposite the proximal spine 707. The proximal bulge 708 may redirect the loose aggregate toward the streamlined side 204 and into the proximal recesses 706, which may then direct the aggregate to a side of the body 200 that is away from the proximal spine 707.

Figure 8:
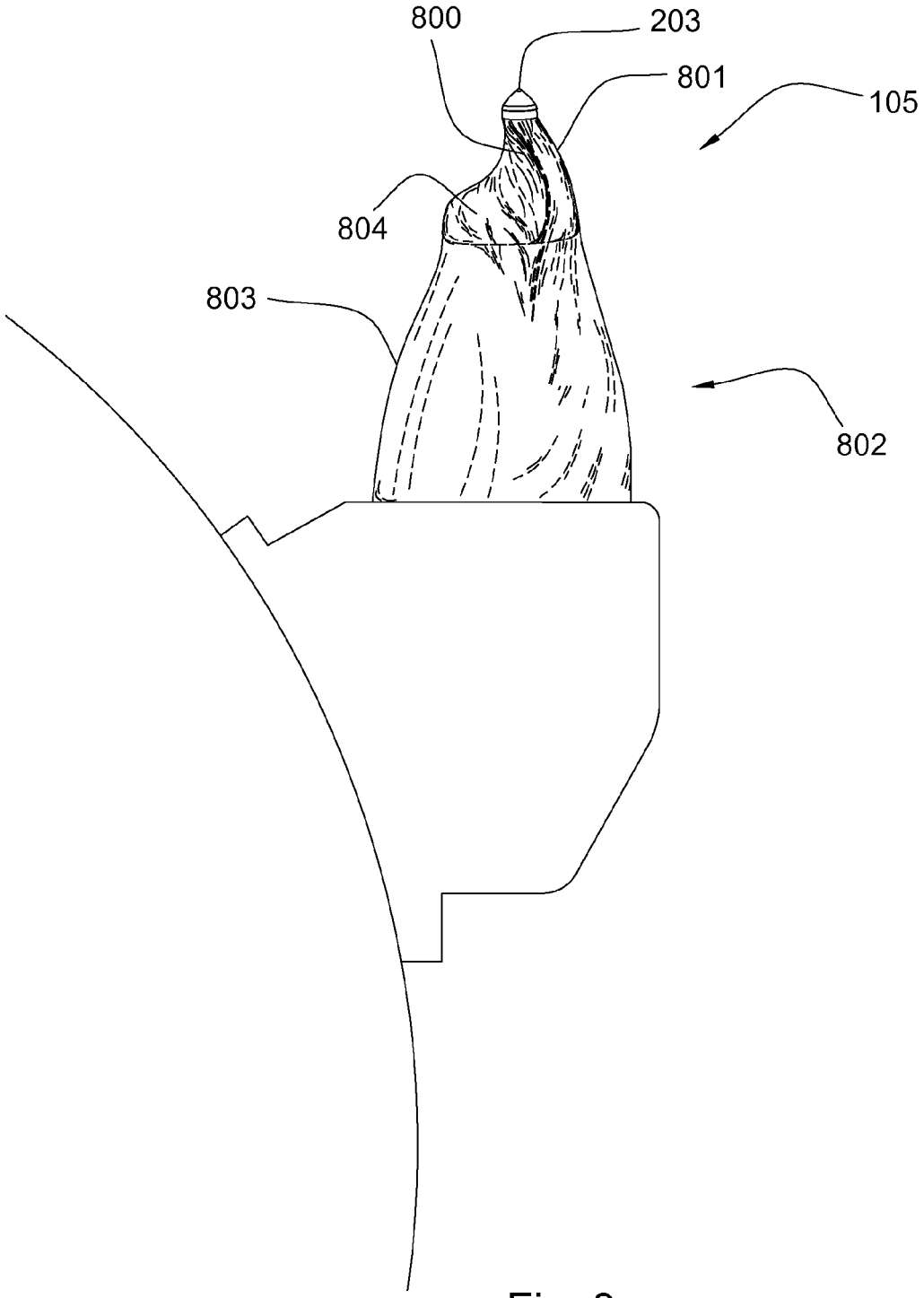
FIG. 8 discloses a perspective view of an embodiment of a pick assembly.

FIG. 8 discloses another embodiment of the pick assembly 105. The current embodiment depicts the pick assembly 105 with at least one recess 800, a spine 801, and a bulge 804. A base portion 802 of the pick assembly 105 may comprise a continuous outer surface 803. The recess 800 may be sufficient in redirecting degraded aggregate around and to either side of the pick assembly 105 to decrease drag. The continuous outer surface 803 may comprise a metal material and may be easier to manufacture than the body comprising recesses.

Figure 9:
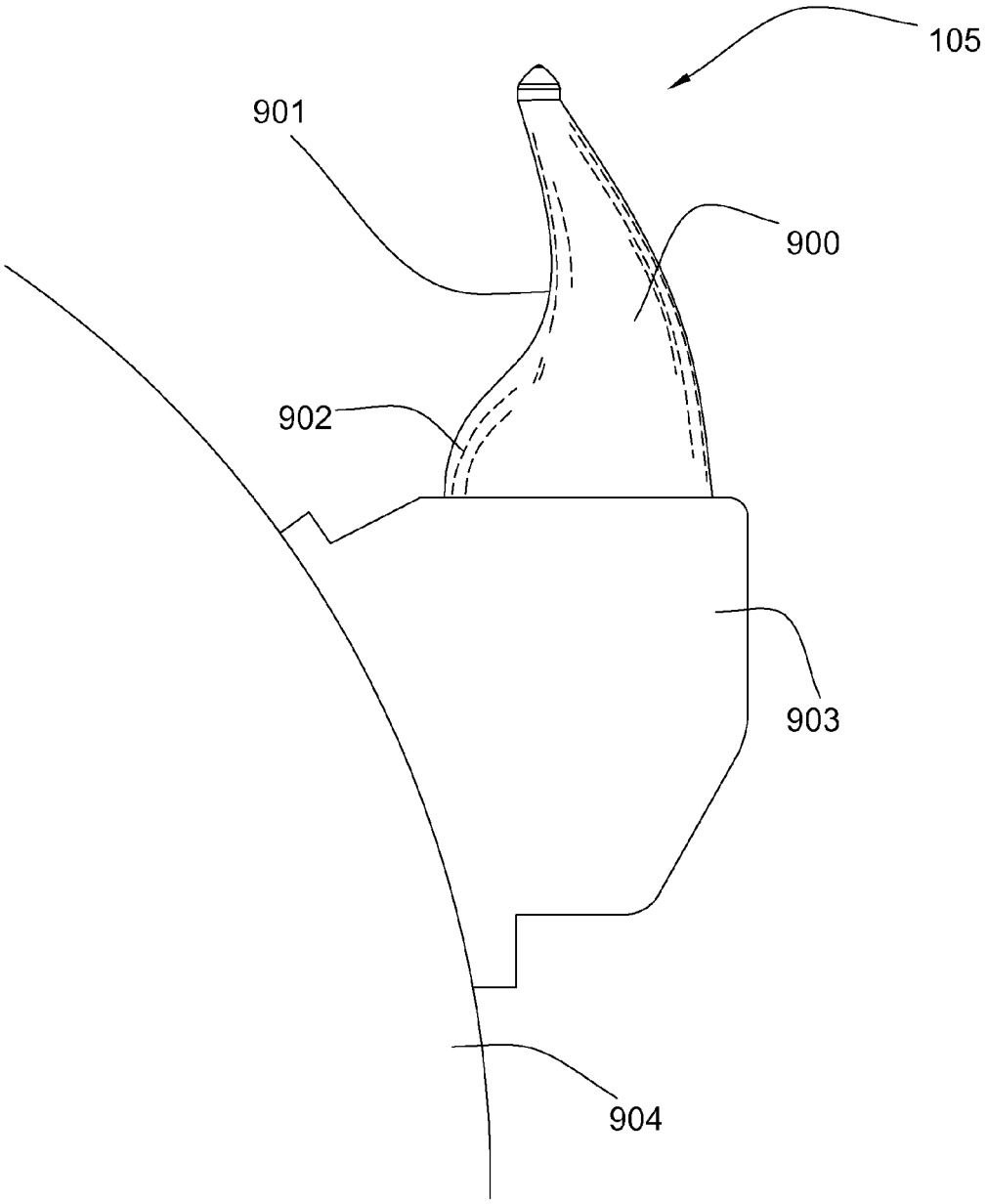
FIG. 9 discloses a perspective view of an embodiment of a pick assembly.

FIG. 9 discloses another embodiment of the pick assembly 105. The embodiment may comprise a spine 900, at least one recess 901, and a bulge 902. The spine 900, recess 901, and bulge 902 may be formed within a same material, which may be a carbide material or a metal such as steel. The spine 900, recess 901, and bulge 902 may be mounted directly into a block 903 of a driving mechanism 904.

Whereas the present invention has been described in particular relation to the drawings attached hereto, it should be understood that other and further modifications apart from those shown or suggested herein, may be made within the scope and spirit of the present invention.

What is claimed is:

1. A pick tool, comprising:

a steel body comprising a front portion and a shank extending from the front portion for attachment to a driving mechanism;

a first cemented metal carbide body attached to the front portion of the steel body;

a second cemented metal carbide body bonded to the first cemented metal carbide body opposite the steel body;

a polycrystalline diamond bonded to the second cemented metal carbide body opposite the first cemented metal carbide body; and wherein at least the steel body and the first cemented metal carbide body comprise a generally longitudinal continuous spinal region.

2. The pick tool of claim 1, wherein at least the steel body and the first cemented metal carbide body comprise recessed portions.

3. The pick tool of claim 1, wherein the spinal region is disposed on the steel body and the first cemented metal carbide body generally opposite a direction of rotation of the driving mechanism.

4. The pick tool of claim 1, wherein the steel body, the first cemented metal carbide body, and the second cemented metal carbide body are coaxial.

5. The pick tool of claim 1, wherein the shank is disposed within a bore of a block mounted on the driving mechanism.

6. The pick tool of claim 5, wherein the shank does not rotate within the bore of the block.

7. The pick tool of claim 5, wherein the shank is rotatable within the bore of the block.

* * * * *